US008499512B2

(12) United States Patent
Pilz et al.

(10) Patent No.: US 8,499,512 B2
(45) Date of Patent: Aug. 6, 2013

(54) EXTERIOR WALL CONSTRUCTION PRODUCT

(75) Inventors: Don A. Pilz, Livermore, CA (US); Raymond E. Poliquin, City of Industry, CA (US); Fernando Hernandez Sesma, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 434 days.

(21) Appl. No.: 12/325,943

(22) Filed: Dec. 1, 2008

(65) Prior Publication Data

US 2009/0178369 A1 Jul. 16, 2009

Related U.S. Application Data

(63) Continuation-in-part of application No. 12/039,685, filed on Feb. 28, 2008, now Pat. No. 8,281,552.

(60) Provisional application No. 61/021,418, filed on Jan. 16, 2008.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/96*** | (2006.01) |
| *E06B 3/54* | (2006.01) |
| *E04B 2/90* | (2006.01) |
| *E04B 2/84* | (2006.01) |
| *E02D 37/00* | (2006.01) |
| *E04B 1/14* | (2006.01) |

(52) U.S. Cl.

CPC ..... *E04B 2/96* (2013.01); *E06B 3/5427* (2013.01); *E04B 2/90* (2013.01); *E04B 2/847* (2013.01); *E02D 37/00* (2013.01); *E04B 1/14* (2013.01)

USPC ..... 52/235; 52/745.09; 52/483.1

(58) Field of Classification Search

USPC ..... 52/48.1, 483.1, 730.1, 730.6, 844, 52/846, 848, 481.1, 489.1, 737, 252, 506.05, 52/235, 283, 236.3, 656.1, 781.3, 745.09, 52/745.21

See application file for complete search history.

(56) References Cited

U.S. PATENT DOCUMENTS 1,130,722 A 3/1915 Fletcher
1,563,651 A * 12/1925 Pomerantz ..... 52/348

(Continued)

FOREIGN PATENT DOCUMENTS

CA 2234347 10/1999
EP 0346126 12/1989

(Continued)

OTHER PUBLICATIONS

FireStik™ by CEMCO Brochure, published on www.firestik.us, in 18 pages.

(Continued)

*Primary Examiner* — William Gilbert
*Assistant Examiner* — Theodore Adamos
(74) *Attorney, Agent, or Firm* — Knobbe Martens Olson & Bear

(57) ABSTRACT

The present application is directed toward slotted tracks, in particular slotted tracks for an exterior wall application. Embodiments can include tracks with elongate reinforcing ribs on the tracks' flanges and/or web, tabs and/or protruding ribs for supporting and positioning exterior sheathing elements, second slot patterns along the length of the web of the track to allow for attachment and drift movement of the track with another wall component, and guide marks to identify proper locations for attachment of fasteners.

4 Claims, 5 Drawing Sheets

U.S. PATENT DOCUMENTS 2,218,426 A 10/1940 Hulbert, Jr.
2,683,927 A 7/1954 Maronek
2,733,786 A * 2/1956 Drake ..... 52/633
3,129,792 A * 4/1964 Gwynne ..... 52/364
3,324,615 A 6/1967 Zinn
3,397,495 A 8/1968 Thompson
3,481,090 A 12/1969 Lizee
3,537,219 A 11/1970 Navarre
3,566,559 A 3/1971 Dickson
3,744,199 A 7/1973 Navarre
3,786,604 A 1/1974 Kramer
3,839,839 A 10/1974 Tillisch et al.
3,908,328 A 9/1975 Nelsson
3,935,681 A 2/1976 Voiturier et al.
3,955,330 A 5/1976 Wendt
3,964,214 A 6/1976 Wendt
3,974,607 A 8/1976 Balinski
4,011,704 A 3/1977 O'Konski
4,103,463 A 8/1978 Dixon
4,130,972 A 12/1978 Varlonga
4,144,335 A 3/1979 Edwards
4,144,385 A 3/1979 Downing
4,152,878 A * 5/1979 Balinski ..... 52/481.1
4,164,107 A 8/1979 Kraemling et al.
4,178,728 A 12/1979 Ortmanns et al.
4,203,264 A 5/1980 Kiefer et al.
4,283,892 A 8/1981 Brown
4,318,253 A 3/1982 Wedel
4,329,820 A 5/1982 Wendt
4,424,653 A 1/1984 Heinen
4,437,274 A * 3/1984 Slocum et al. ..... 52/105
4,649,089 A 3/1987 Thwaites
4,672,785 A 6/1987 Salvo
4,709,517 A 12/1987 Mitchell et al.
4,723,385 A 2/1988 Kallstrom
4,787,767 A 11/1988 Wendt
4,825,610 A 5/1989 Gasteiger
4,850,385 A 7/1989 Harbeke
4,885,884 A 12/1989 Schilger
4,918,761 A 4/1990 Harbeke
4,930,276 A 6/1990 Bawa et al.
5,010,702 A 4/1991 Daw et al.
5,094,780 A 3/1992 von Bonin
5,103,589 A 4/1992 Crawford
5,125,203 A 6/1992 Daw
5,127,203 A 7/1992 Paquette
5,127,760 A * 7/1992 Brady ..... 403/230
5,146,723 A 9/1992 Greenwood et al.
5,155,957 A 10/1992 Robertson et al.
5,157,883 A * 10/1992 Meyer ..... 52/357
5,167,876 A 12/1992 Lem
5,173,515 A 12/1992 von Bonin et al.
5,222,335 A 6/1993 Petrecca
5,244,709 A 9/1993 Vanderstukken
5,285,615 A 2/1994 Gilmour
5,325,651 A 7/1994 Meyer et al.
5,347,780 A 9/1994 Richards et al.
5,367,850 A 11/1994 Nicholas
5,374,036 A 12/1994 Rogers et al.
5,390,465 A 2/1995 Rajecki
5,394,665 A 3/1995 Johnson
5,412,919 A 5/1995 Pellock et al.
5,452,551 A 9/1995 Charland et al.
5,456,050 A 10/1995 Ward
5,471,805 A 12/1995 Becker
5,552,185 A 9/1996 De Keyser
5,592,796 A 1/1997 Landers
5,604,024 A 2/1997 von Bonin
5,644,877 A 7/1997 Wood
5,687,538 A * 11/1997 Frobosilo et al. ..... 52/846
5,689,922 A 11/1997 Daudet
5,709,821 A 1/1998 von Bonin et al.
5,755,066 A 5/1998 Becker
5,787,651 A 8/1998 Horn et al.
5,797,233 A 8/1998 Hascall
5,806,261 A 9/1998 Huebner et al.
5,913,788 A 6/1999 Herren
5,921,041 A 7/1999 Egri, II
5,927,041 A 7/1999 Sedlmeier et al.
5,930,963 A 8/1999 Nichols
5,950,385 A * 9/1999 Herren ..... 52/481.1
5,968,669 A 10/1999 Liu et al.
6,058,668 A 5/2000 Herron
6,110,559 A 8/2000 De Keyser
6,151,858 A 11/2000 Ruiz et al.
6,176,053 B1 1/2001 St. Germain
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,305,133 B1 10/2001 Cornwall
6,374,558 B1 4/2002 Surowiecki
6,405,502 B1 6/2002 Cornwall
6,430,881 B1 8/2002 Daudet et al.
6,470,638 B1 10/2002 Larson
6,647,691 B2 11/2003 Becker et al.
6,679,015 B1 1/2004 Cornwall
6,705,047 B2 3/2004 Yulkowski
6,732,481 B2 5/2004 Stahl, Sr.
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 3/2005 Stover
7,043,880 B2 5/2006 Morgan et al.
7,152,385 B2 12/2006 Morgan et al.
7,191,845 B2 3/2007 Loar
7,240,905 B1 7/2007 Stahl, Sr.
7,302,776 B2 12/2007 Duncan et al.
7,506,478 B2 3/2009 Bobenhausen
7,540,118 B2 6/2009 Jensen
7,617,643 B2 11/2009 Pilz et al.
7,681,365 B2 3/2010 Klein
7,752,817 B2 7/2010 Pilz et al.
7,775,006 B2 8/2010 Giannos
7,776,170 B2 8/2010 Yu et al.
7,814,718 B2 10/2010 Klein
7,827,738 B2 11/2010 Abrams et al.
7,866,108 B2 1/2011 Klein
7,950,198 B2 5/2011 Pilz et al.
8,056,293 B2 11/2011 Klein
8,061,099 B2 11/2011 Andrews
8,074,416 B2 12/2011 Andrews
8,087,205 B2 1/2012 Pilz et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,322,094 B2 12/2012 Pilz et al.
2002/0170249 A1 11/2002 Yulkowski
2003/0079425 A1 5/2003 Morgan et al.
2003/0089062 A1 5/2003 Morgan et al.
2003/0213211 A1 11/2003 Morgan et al.
2004/0010998 A1 1/2004 Turco
2004/0045234 A1 3/2004 Morgan et al.
2004/0139684 A1 * 7/2004 Menendez ..... 52/720.1
2004/0211150 A1 10/2004 Bobenhausen
2005/0183361 A1 * 8/2005 Frezza ..... 52/293.3
2005/0246973 A1 11/2005 Jensen
2006/0032163 A1 2/2006 Korn
2006/0123723 A1 6/2006 Weir et al.
2006/0137293 A1 6/2006 Klein
2007/0056245 A1 * 3/2007 Edmondson ..... 52/726.2
2007/0068101 A1 3/2007 Weir et al.
2007/0193202 A1 8/2007 Rice
2007/0261343 A1 11/2007 Stahl, Sr.
2008/0087366 A1 4/2008 Yu et al.
2008/0134589 A1 6/2008 Abrams et al.
2008/0172967 A1 7/2008 Hilburn
2008/0250738 A1 * 10/2008 Howchin ..... 52/235
2009/0038764 A1 2/2009 Pilz et al.
2009/0049777 A1 2/2009 Pilz et al.
2009/0049781 A1 2/2009 Pilz et al.

| | | | |
|---|---|---|---|
| 2009/0090074 | A1 | 4/2009 | Klein |
| 2009/0094912 | A1 | 4/2009 | Klein |
| 2009/0178363 | A1 | 7/2009 | Pilz et al. |
| 2010/0126092 | A1 | 5/2010 | Pilz et al. |
| 2010/0170172 | A1 | 7/2010 | Klein |
| 2011/0113709 | A1 | 5/2011 | Pilz et al. |
| 2011/0185656 | A1 | 8/2011 | Klein |
| 2011/0214371 | A1 | 9/2011 | Klein |
| 2011/0247281 | A1 | 10/2011 | Pilz et al. |
| 2012/0066989 | A1 | 3/2012 | Pilz et al. |

FOREIGN PATENT DOCUMENTS

| | | |
|---|---|---|
| GB | 2159051 | 11/1985 |
| GB | 2411212 | 8/2005 |
| JP | 06146433 | 5/1994 |
| JP | 06220934 | 8/1994 |
| WO | WO 03/038206 | 5/2003 |
| WO | WO 2007/103331 | 9/2007 |
| WO | WO 2009/026464 | 2/2009 |

OTHER PUBLICATIONS

Order form from Stockton Products for Soffit Vent / Reveal Screed, in 1 page.

DoubleTrack™ information sheets by Dietrich Metal Framing, in 2 pages.

Catalog page from Stockton Products, printed from www.stocktonproducts.com, on Dec. 16, 2007, showing #5 Drip, in 1 page.

International Search Report for Application No. PCT/US2008/073920, dated Apr. 9, 2009.

Canadian First Office Action for Application No. 2,697,295, dated Sep. 21, 2011, in 4 pages.

Canadian First Office Action for Application No. 2,697,295, dated May 23, 2012, in 2 pages.

Information Disclosure Statement letter, dated Aug. 4, 2011.

* cited by examiner

EXTERIOR WALL CONSTRUCTION PRODUCT

RELATED APPLICATIONS

This application is a continuation-in-part of U.S. patent application Ser. No. 12/039,685, filed Feb. 28, 2008, the entire contents of which are incorporated by reference herein, which claims benefit under 35 U.S.C. §119(e) to U.S. Provisional Patent Application No. 61/021,418, filed on Jan. 16, 2008, the entire contents of which are incorporated by reference herein. Also incorporated herein in their entireties by reference are U.S. application Ser. No. 12/013,361, entitled Fire Rated Wall Construction Product, filed Jan. 11, 2008, and U.S. application Ser. No. 12/040,658, entitled Two-Piece Track System, filed Feb. 29, 2008.

BACKGROUND OF THE INVENTION

1. Field of the Invention

This application is directed toward a header track device for use in building construction, particularly for use in the exterior wall of a building.

2. Description of the Related Art

Header tracks, including slotted tracks, are commonly used in the construction industry, including in the exterior walls of buildings. They generally resemble a U-shaped (or some other similarly shaped) elongated channel capable of receiving or covering the ends of wall studs and holding the wall studs in place.

The slotted tracks generally have a web and at least one flange. Typically, the track includes a pair of flanges, which extend in the same direction from opposing edges of the web. Along the flanges of the slotted tracks generally is a plurality of slots. When the wall studs are placed into a slotted track, the plurality of slots accommodate fasteners to permit attachment of the wall studs to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move.

Also along the flanges of the slotted tracks generally are areas for attachment of exterior sheathing elements. However, in many current slotted tracks, the slots take up the majority of the flanges of the track, leaving little room for attachment of exterior sheathing elements. For example, angle-shaped sheet metal tracks are commonly used on the outsides of wall studs. Each of these angle-shaped sheet metal tracks has a top web portion and one extending flange portion. The extending flange portion normally has a plurality of slots, but the slots extend nearly to the intersection of the flange and web. Because of this, there is little room for attachment of exterior sheathing elements to the flange of the slotted track.

SUMMARY OF THE INVENTION

It has been discovered by the present inventor that it is also often difficult to identify the proper location for attachment of an exterior sheathing element along the flange of a slotted track. If the sheathing elements are misaligned and overlap a portion of the plurality of slots, the generally orthogonal movement of the studs can be limited due to interference between the stud fastener, which passes through one of the plurality of slots, and the sheathing element.

This application is directed toward an improved slotted track device and system capable of use in building construction. It is well-suited for use in the exterior wall of a building, but can be used in other applications as well. The device includes a plurality of slots located along at least one flange of the slotted track. The slots permit attachment of the slotted track to a wall stud or studs. The slots also allow for generally orthogonal movement of the wall studs relative to the slotted track during an earthquake or some other event where movement of the studs is desired.

In at least one embodiment, the device includes at least one elongate reinforcing structure, such as a protrusion or rib, which extends along at least one portion of the track to provide added stability to the slotted track. The rib can protrude outwardly or inwardly from the slotted track.

In one embodiment, an outward rib along the flange of the track has a secondary function in providing a ridge against which an exterior sheathing element can rest. This ridge helps to ensure proper alignment or placement of the exterior sheathing element during attachment of the sheathing element to the slotted track, and can have a triangular-shaped cross-section.

It is also contemplated that in at least one embodiment the present inventive slotted track comprises a plurality of tabs. The tabs are located along a flange of the slotted track and provide resting points for the exterior sheathing elements during attachment of the sheathing elements to the slotted track.

In at least one embodiment the slotted track also comprises a plurality of second slots laterally positioned along the web of the track which permit attachment of the slotted track to a floor or other wall element. The plurality of second slots can be of various shapes, and can allow for drift movement of the track in various directions. For example, in one embodiment the second slots have a generally cross-like pattern, allowing for drift movement in multiple directions.

A system is also contemplated which incorporates a slotted track and connection element. In at least one embodiment, the connection element acts as a washer, and includes a rubber or other compressible material layer which presses against the underside of the web. The connection element has a hole or holes through which a nail or other fastening element is placed. The connection element can also have a geometrical profile substantially similar to that of at least a portion of the web.

In yet another embodiment, an elongate track for receiving wall studs is contemplated, the track comprising a web portion, at least one flange portion having a plurality of slots, and at least one guide mark located along the at least one flange portion, the guide mark configured to identify a particular area within one or more slots and, in some arrangements, within each slot, where a fastener should be positioned.

In yet another embodiment, an elongate track for receiving wall studs is contemplated, the track comprising a web portion comprising a repeating pattern of slots, at least some of the slots being located nearer the elongate central portion of the web, wherein the pattern of slots is configured to provide at least one location for attachment of the elongate track to another wall component.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. The drawings include nine (9) figures.

It is to be understood that the attached drawings are for the purpose of illustrating concepts of the embodiments discussed herein and may not be to scale.

DETAILED DESCRIPTION OF THE PREFERRED EMBODIMENT

Figure 1:
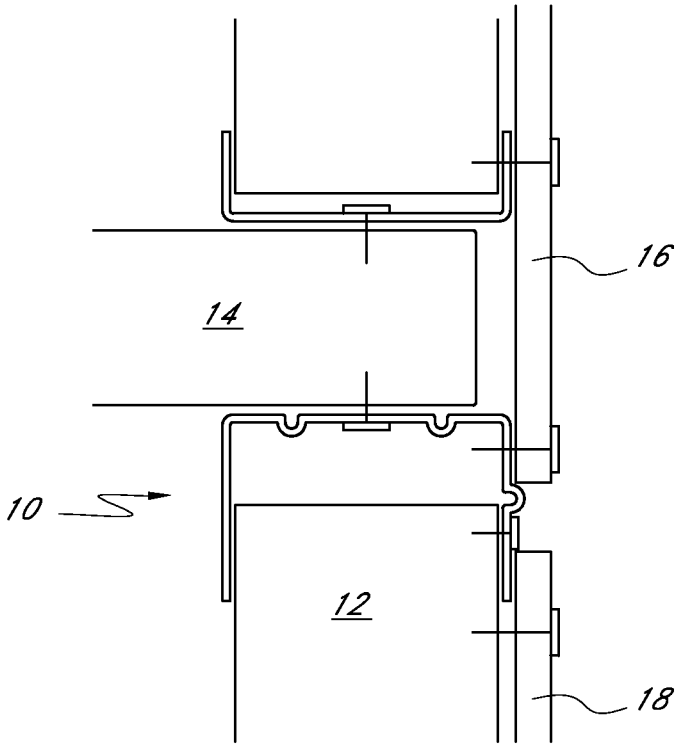
FIG. 1 illustrates a cross-sectional view of the exterior portion of a building, including a slotted track, a floor slab, a wall stud, and two pieces of exterior sheathing.

Referring to FIG. 1, the inventive slotted track 10 can be used with a wall stud 12, a floor slab 14, and two pieces of exterior sheathing elements 16 and 18. In use, the slotted track 10 is connected to the bottom surface of floor slab 14 by an acceptable fastening means. In the illustrated arrangement, the floor slab 14 is solid; however, it is also possible to use the track 10 with other types of floors (e.g., fluted floor decks) and other suitable structures, as well. The two exterior sheathing elements 16 and 18 are positioned and attached alongside the exterior portion of the slotted track 10 such that a lower end of upper sheathing element 16 ends just prior to a plurality of slots (not shown in FIG. 1) along a portion of one flange of the slotted track 10.

Figure 2:
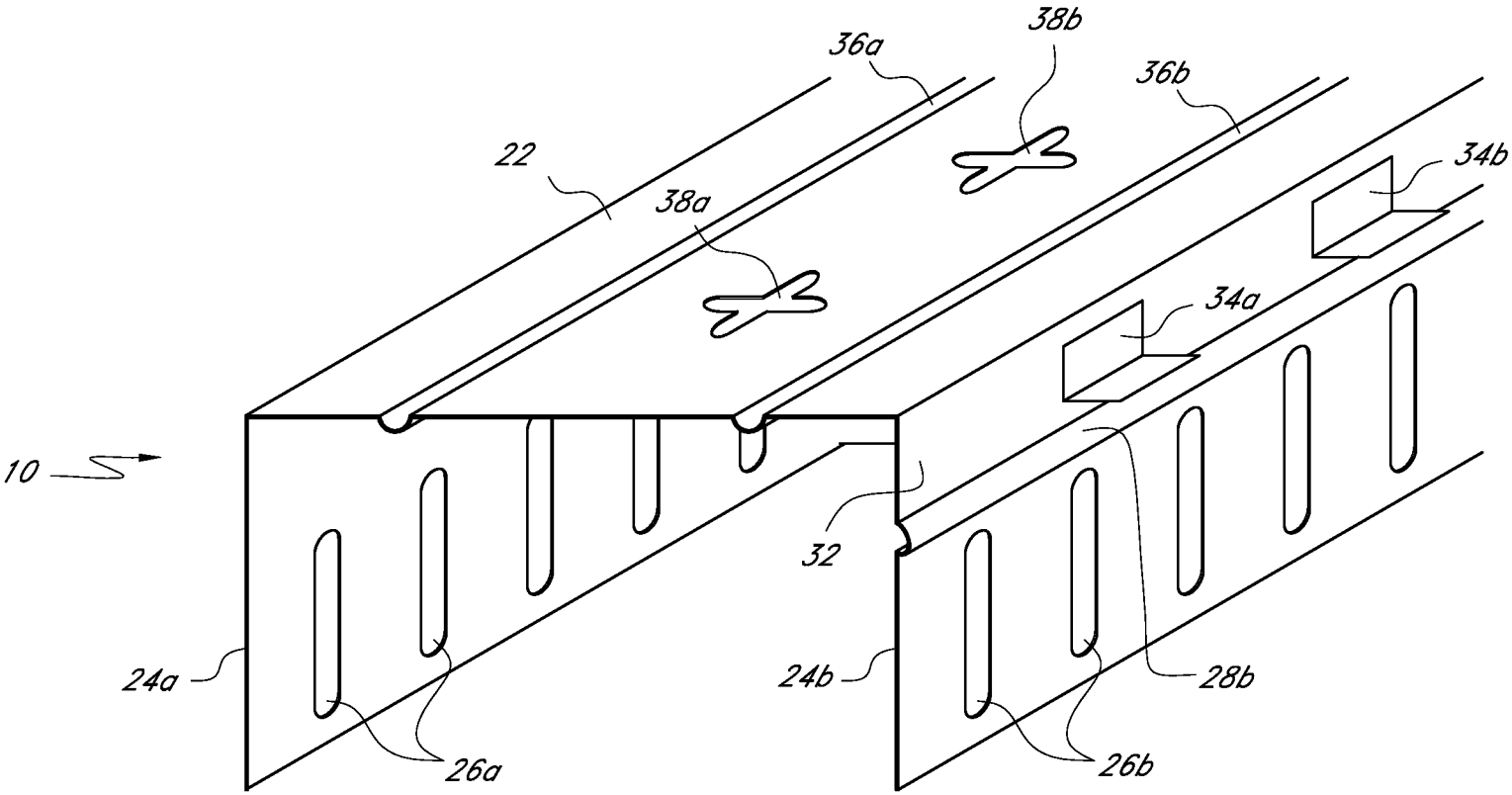
FIG. 2 illustrates a perspective view of an embodiment of the slotted track of FIG. 1, further comprising a plurality of tabs.

Referring to FIG. 2, an embodiment of the slotted track 10 comprises a web 22, two flanges 24*a* and 24*b*, and a plurality of slots 26*a* and 26*b* along each of the flanges 24*a* and 24*b*. These slots 26*a* and 26*b* are configured to allow the shaft portion of a fastener, such as a threaded fastener, to pass through the slots 26*a* and 26*b* and into the stud 12 to permit attachment of the slotted track 10 to the wall stud 12. The slots 26*a* and 26*b* also generally allow for orthogonal movement of the fastener within the slots 26*a* and 26*b* and, thus, movement of the wall stud 12 relative to the slotted track 10. As discussed above, in those areas of the world where earthquakes are common, movement of the wall studs is important. If the wall studs are rigidly attached to the slotted track and not allowed to move freely in at least one direction, the stability of the wall and the building might be compromised. Thus, with the plurality of slots 26*a* and 26*b* provided in the present slotted track 10, the wall stud 12 is free to move.

In some embodiments, an elongate reinforcing rib 28*b* may be provided along flange 24*b*. In some embodiments, the rib can include a groove along its back side. The rib 28*b* protrudes outwards, and provides added stability to the slotted track 10. In other embodiments, the rib can protrude inwardly. In the embodiment of FIG. 2, one rib is used on flange 24*b*. However, more than one rib can also be used. A rib or ribs can be used on flange 24*a* as well to provide added stability. Additionally, a sheathing attachment area 32 is located above and adjacent the rib 28*b*. The sheathing attachment area 32 is large enough to attach sheathing elements as well as provide added stability to the slotted track 10.

During installation, the sheathing element 16 can be placed against the sheathing attachment area 32 such that the sheathing element's lower portion rests on top of the rib 28*b*. The rib 28*b* thus helps to align the sheathing element 16 relative to the track 10 so that sheathing element 16 does not cover a portion of the plurality of slots 26*b* and prevent the generally orthogonal movement of the wall stud 12.

Still referring to FIG. 2, the slotted track 10 may further (or alternatively) comprise tabs 34*a* and 34*b*. The tabs 34*a* and 34*b* can be made integral with the slotted track 10 or separately applied to the slotted track 10 either mechanically or by other means. In at least one embodiment, the tabs 34*a* and 34*b* can be fold-down tabs. The tabs 34*a* and 34*b* can lock in place once they have folded down to a certain point or angle. For example, the tabs can have hinges (not shown) which only allow the tab to fold down 90 degrees. In at least one embodiment, the tab 34*a*, 34*b* may contact the rib 28*b* when folded such that the rib 28*b* provides some amount of support to the tab 34*a*, 34*b*. In yet other embodiments, the tabs 34*a* and 34*b* can include a lip or rib (not shown) for holding the sheathing element 16 in place while it is being attached. During installation of the sheathing elements, the tabs help to align the sheathing element 16 so that sheathing element 16 does not cover a portion of the plurality of slots 26*b* and prevent the generally orthogonal movement of the wall stud 12. While the present embodiment includes two tabs per standard sheet of sheathing element 16 (FIG. 1), additional embodiments can include other numbers of tabs. Furthermore, in at least one embodiment, the tabs can be spaced evenly along the sheathing attachment area 32 of slotted track 10.

The slotted track 10 may further comprise elongate reinforcing ribs 36*a* and 36*b* along the web 22. Ribs 36*a* and 36*b* provide added stability to the slotted track 10. Positioned between ribs 36*a* and 36*b*, and laterally positioned along the web 22 of slotted track 10, are second slots 38*a* and 38*b*. The second slots can be of various shapes, including but not limited to that of a cross slot. In at least one embodiment, the second slots 38*a* and 38*b* allow for drift and seismic movement of the track 10. While the present embodiment includes two second slots, additional embodiments can include other numbers of second slots.

Figure 3:
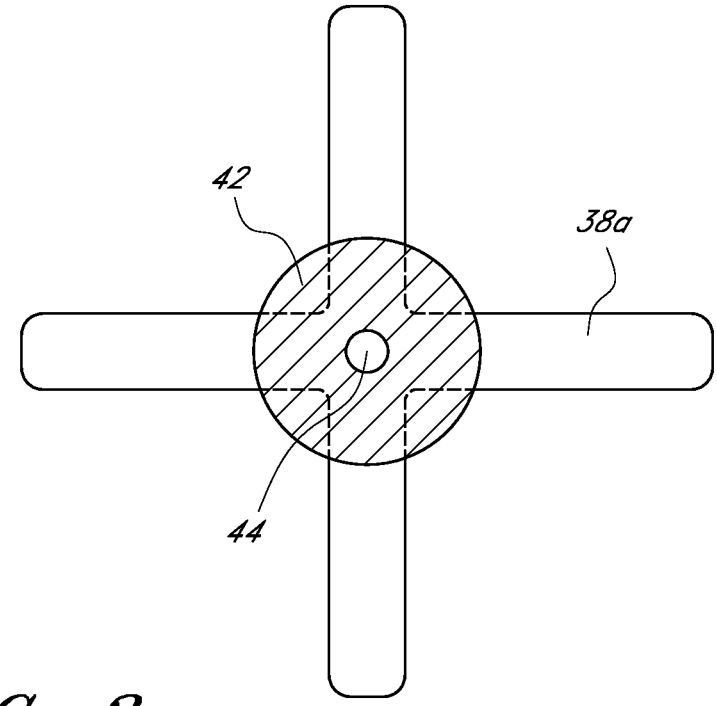
FIG. 3 illustrates a bottom plan view of a second slot located along the web of the slotted track of FIG. 2.
Figure 4:
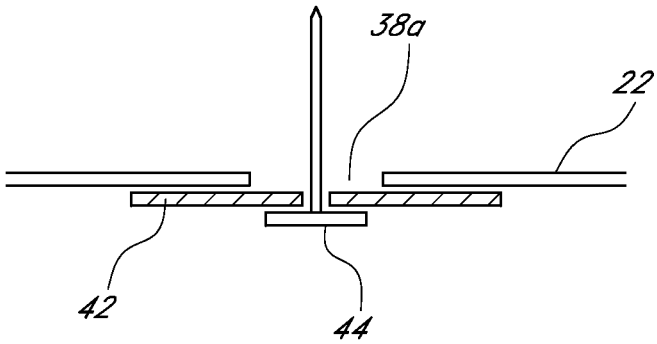
FIG. 4 illustrates a cross sectional view of the second slot of FIG. 3.

Referring to FIGS. 3 and 4, the second slot 38*a* can be used with a washer 42 and fastener 44, such as a threaded fastener, for example. The fastener 44 contacts the washer 42, which is positioned between the head of the fastener and the web 22 of slotted track 10, and fastens the slotted track 10 to the floor slab 14. Once fastened, the second slot 38*a* allows for drift and seismic movement of the slotted track 10 in multiple directions.

Figures 5, 6, 7:
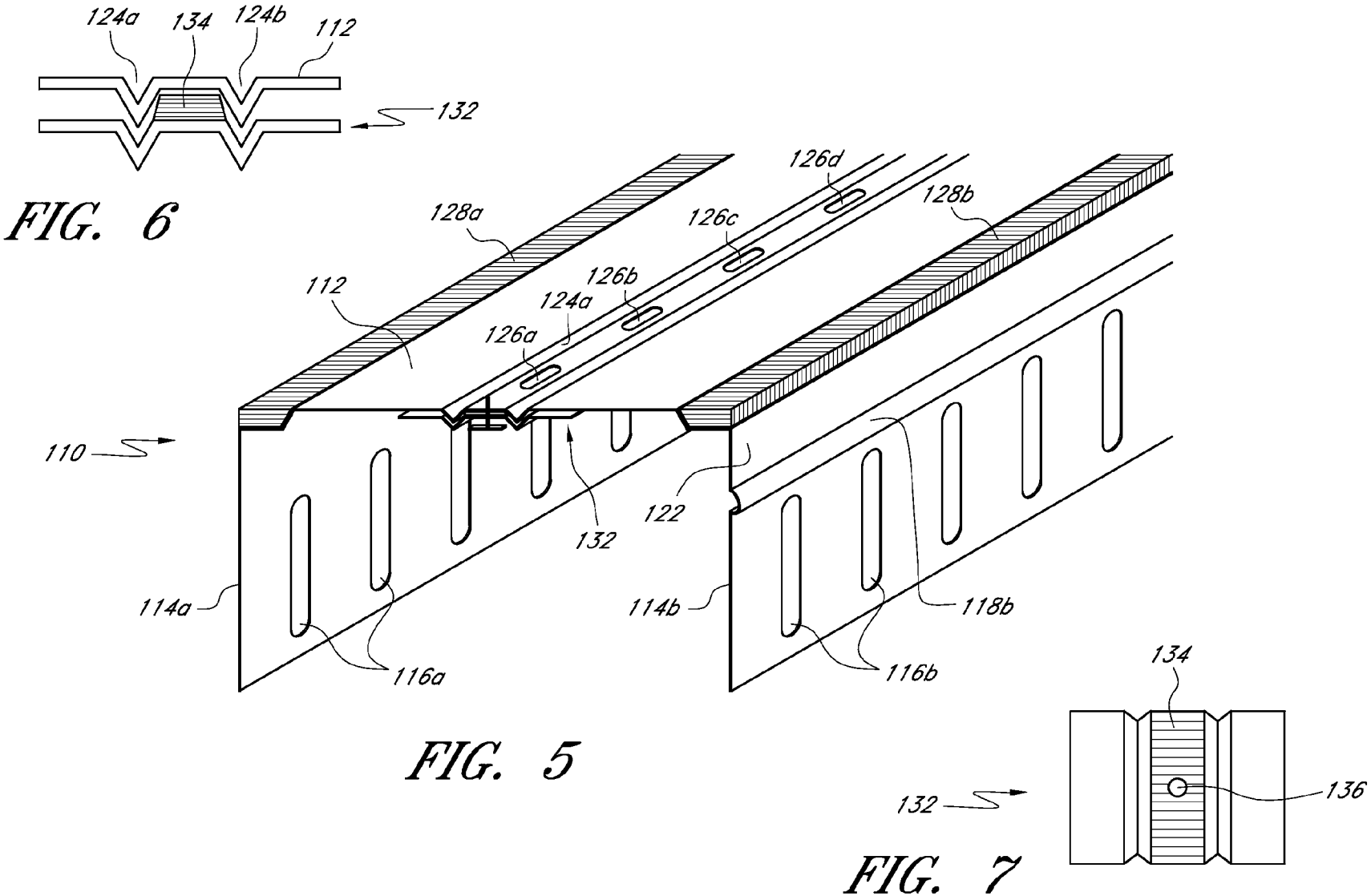
FIG. 5 illustrates a perspective view of an embodiment of a slotted track system, including a connection element.
FIG. 6 illustrates a cross sectional view of the connection element of FIG. 5.
FIG. 7 illustrates a top plan view of the connection element of FIG. 5.

Referring to FIG. 5, an embodiment of a slotted track system incorporates a slotted track 110. The slotted track 110 comprises a web 112, two flanges 114*a* and 114*b*, a plurality of slots 116*a* and 116*b*, a rib 118*b* along the flange, a sheathing attachment area 122, ribs 124*a* and 124*b* along the web, and second slots 126*a-d* located along the web. The slotted track 110 additionally comprises strips of intumescent material 128*a* and 128*b* attached to at least a portion of the web 112. In use, the intumescent material expands rapidly when heated, thus sealing off areas around the slotted track 110 and helping to prevent fire, smoke, or other debris from moving past or around the slotted track 110.

The slotted track system additionally incorporates a connection element 132. The connection element 132 can be applicable to both interior and exterior walls. In at least one embodiment, the connection element 132 can have a substantially W-shape. Referring to FIG. 6, the connection element 132 has a geometrical profile substantially similar to that of at least a portion of the web 112. This allows the connection element 132 to remain close to or contact the web 112 once attached. A strip of compressive material 134, such as for example rubber, can be attached to the connection element 132. The compressive material 134 is configured to be positioned between the connection element 132 and the web 112. Referring to FIGS. 5 and 7, a fastener extends through a hole 136 in the compressive material 134 and connection element 132 and through one of the second slots 126 in the web 112 to secure the track 110 to a floor slab. The compressive material 134 compresses under pressure when the connection element 132 is attached to the slotted track 110 and acts as a gasket. The compressive material 134 additionally allows the slotted track 110 to have drift movement along the second slots 126 of slotted track 110.

Figure 8:
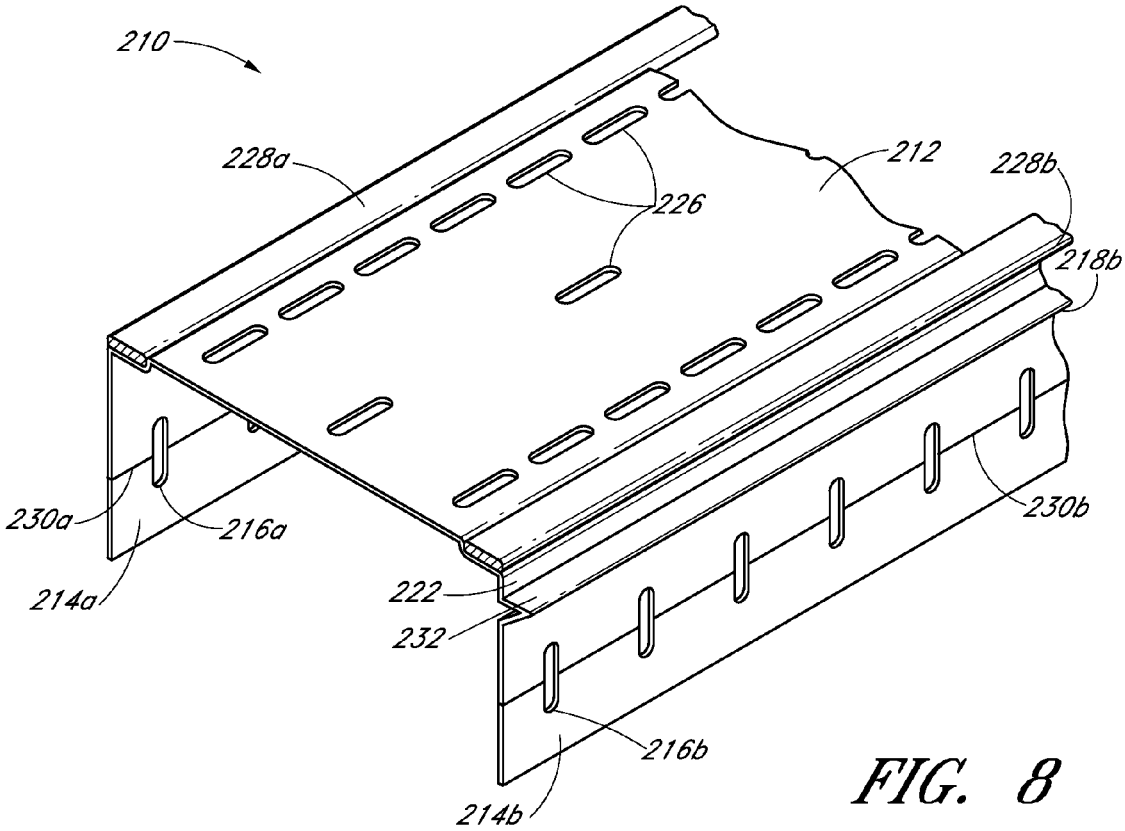
FIG. 8 illustrates a perspective view of an embodiment of a slotted track.

With reference to FIG. 8, an embodiment of a slotted track 210 can comprise a web 212, flanges 214*a* and 214*b*, a plurality of slots 216*a* and 216*b*, a protruding rib 218*b* along the flange, a sheathing attachment area 222, a pattern or patterns of second slots 226, strips of fire-retardant material 228*a* and 228*b* attached to at least a portion of the web 212, and marking guides 230*a* and 230*b* along the flanges. In yet other embodiments the track 212 can include just one flange 214, and/or more than one protruding rib 218. Other configurations and combinations of the above-listed elements are also possible. For example, a track for some applications may omit one or more of the slots 216, strips of fire-retardant material 228, marking guides 230, possibly among other of the above-recited features.

With continued reference to FIG. 8, in at least some embodiments the protruding rib 218 can have a triangular-shaped cross section, with a generally flat shelf portion 232 extending from the flange for placement of a piece of exterior sheathing. This triangular-shaped cross section and shelf can provide added structural support for the track 212, as well as any attached exterior sheathing. In at least some embodiments, shelf portion 232 can extend at a generally 90 degree angle from the flange 214*a* and/or 214*b*. In yet other embodiments the shelf portion 232 can be slightly angled in relation to the flange. For example, the shelf portion 232 and flange 214*b* can form an acute angle along the top of the protruding rib where the exterior sheathing is to rest. In such embodiments, the angle of the shelf and/or force of gravity can inhibit the exterior sheathing from slipping off of the track. The protruding rib 218*b* can have other shapes and/or cross sections as well, including but not limited to a v-shape, u-shape, or any other shape which can aid in attaching and/or retaining a piece of exterior sheathing. In at least some embodiments, the exterior sheathing can have a width, or thickness, of between about one-half inch and one inch. In some arrangements, the sheathing has a thickness of approximately ½, ⅝ or ⅞ inches. In some embodiments, the width of the shelf portion 232 can be identical to the width of the sheathing so as to provide a support area for the entire lower edge of the sheathing. In other embodiments, the width of the shelf portion can be less than or greater than the width of the sheathing. In one particular embodiment, the width of the shelf portion 232 is configured to provide a surface of a sufficient width to support the sheathing element at least for a period of time sufficient for the sheathing element to be secured to the studs and/or tracks. The shelf portion 232 may define a width that is less than the width of the sheathing element such that the shelf portion 232 does not protrude beyond the sheathing element. For example, the shelf portion 232 may be approximately one-half or less as wide, one-quarter or less as wide or one-eighth or less as wide as the sheathing element.

With continued reference to FIG. 8, the track 210 can include a guide mark or marks 230*a* and 230*b*. The guide marks can comprise a line, protrusion, rib, or any other marking which identifies locations for attachment of fasteners, including but not limited to screws, bolts, and/or rivets. For example, one guide mark can comprise a black (or other color) piece of tape added during manufacturing which identifies the central portion of each slot along the flange 214*b*. In other embodiments, the guide mark can comprise a laser mark, or ink mark, which preferably is sufficiently permanent to last through at least a normal period of time and under normal conditions of manufacturing, storage, shipping, and assembly. The guide mark 230*a* and/or 230*b* can be used to ensure that the track 210 is fastened appropriately and/or evenly to another wall component or components during building construction. Preferably, the guide mark 230*a* and/or 230*b* is located near the center of the slot, so that a stud member within the track can move equally up and down relative to the track. This can help to ensure maximum deflection capability of the stud within the wall assembly. In other embodiments, the guide mark can be offset from the center to allow for other ranges of stud movement.

Figure 9:
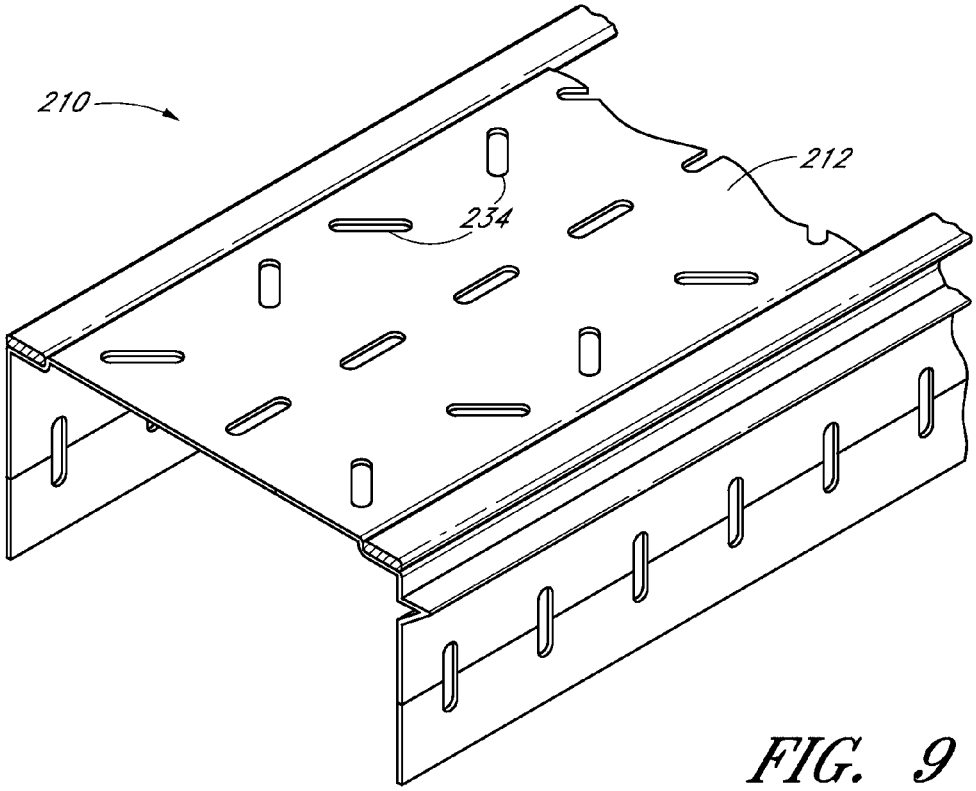
FIG. 9 illustrates a perspective view of an embodiment of a slotted track.

With reference to FIGS. 8 and 9, the web 212 can include a pattern or patterns of second slots. For example, and with reference to FIG. 8, second slots 226 can be arranged along the web portion such that at least some of the second slots 226 are closer to a central portion of the web than are other second slots 226. The pattern or patterns can vary. With continued reference to FIG. 8, the pattern can include a series of closely located second slots along both edges of the web 212, as well as scattered second slots along the center of the web 212. With reference to FIG. 9, in at least some embodiments a slot pattern can include second slots 234 which are diagonally opposed to one another. Other configurations and types of second slots are also possible.

The use of slot patterns can facilitate fastening of the track 210 to another wall component, especially when the other wall component does not line up exactly with the track 210. For example, the wall component may have openings or hollow areas adjacent some or all of the second slots which run down the center of the web 212. If all of the second slots were located along the center of the web 212, it may not be possible to attach the track 210 to the other wall component in those areas. Thus, attachment of a track 210 to another other wall component can be more easily accomplished by incorporating a pattern or patterns of second slots which are spread out along the web 212.

In addition, drift movement of the track 210 can also be possible with slot patterns such as those illustrated in FIGS. 8 and 9. For example, the second slots 226 of FIG. 8 and or the second slots 234 of FIG. 9 can be elongated such that the track 210 can drift along the second slots during a seismic event. The second slots can also be shaped in the form of a cross slot, thereby facilitating drift movement in multiple directions. Other configurations are also possible.

The present application does not seek to limit itself to only those embodiments discussed above. Other embodiments resembling tracks, wall systems, or other wall components are possible as well. Various geometries and designs may be used in the wall components to accommodate the use of fire-retardant material and/or sheathing attachment. Additionally, various materials may be used. In at least some embodiments the wall component and wall system materials can comprise steel, iron, or other material having at least some structural capacity. The fire-retardant materials can comprise intumescent material, such as for example BLAZESEAL™, or some other material which accomplishes the same purposes as those described above.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A building structure, comprising:

a first wall having a lower end and an upper end, comprising:

a plurality of vertical studs; and a header track comprising a web and two flanges extending from opposite sides of the web, the web and two flanges forming a periphery of the header track such that the header track forms an overall generally C-shaped structure having empty space defined between the two flanges, the generally C-shaped structure being sized and shaped to receive the vertical studs, the header track extending in a generally horizontal direction along the upper end of the first wall and interconnecting the plurality of vertical studs, wherein the header track comprises an elongate protrusion extending along a length of the header track, the elongate protrusion being spacially offset from a plane containing the web;

a second wall having a lower end and an upper end, the second wall positioned above the first wall;

a floor positioned horizontally between the first and second walls;

a sheathing element having an upper end and a lower end, the sheathing element covering at least a portion of the second wall and floor, the lower end of the sheathing element overlapping a portion of the header track;

wherein the lower end of the sheathing element rests upon the elongate protrusion.

2. The building structure of claim 1, wherein an upper surface of the elongate protrusion is flat.

3. The building structure of claim 1, additionally comprising a plurality of fasteners, each of which couples the header track with one of the plurality of vertical studs, wherein the protrusion is positioned above the plurality of fasteners.

4. A method of assembling a building structure, the structure comprising a first wall having a lower end and an upper end, the first wall comprising a plurality of vertical studs and a header track, the header track comprising a web and two flanges extending from opposite sides of the web, the web and two flanges forming a periphery of the header track such that the header track forms an overall generally C-shaped structure having empty space defined between the two flanges, the generally C-shaped structure being sized and shaped to receive the vertical studs, the header track extending in a generally horizontal direction along the upper end of the first wall and interconnecting the plurality of vertical studs, wherein the header track comprises an elongate protrusion extending along a length of the header track, the elongate protrusion being spacially offset from a plane containing the web, the structure further comprising a second wall having a lower end and an upper end, the second wall positioned above the first wall, the structure further comprising a floor positioned horizontally between the first and second walls, the structure further comprising a sheathing element having an upper end and a lower end, the sheathing element covering at least a portion of the second wall and floor, the lower end of the sheathing element overlapping a portion of the header track, wherein the method comprises:

resting the sheathing element on the elongate protrusion and then securing the sheathing element to the second wall by one or more fasteners.

* * * * *

UNITED STATES PATENT AND TRADEMARK OFFICE

CERTIFICATE OF CORRECTION

PATENT NO. : 8,499,512 B2
APPLICATION NO. : 12/325943
DATED : August 6, 2013
INVENTOR(S) : Pilz et al.

It is certified that error appears in the above-identified patent and that said Letters Patent is hereby corrected as shown below:

In the Specification

In column 6 at line 52, Change “and or” to --and/or--.

In the Claims

In column 7 at line 40, In Claim 1, change “spacially” to --spatially--.

In column 8 at line 30 (approx.), In Claim 4, change “spacially” to --spatially--.

Signed and Sealed this
Thirtieth Day of September, 2014

Michelle K. Lee

Michelle K. Lee
*Deputy Director of the United States Patent and Trademark Office*